US010202738B2

(12) United States Patent
Derkson

(10) Patent No.: US 10,202,738 B2
(45) Date of Patent: Feb. 12, 2019

(54) MODULAR TILE PLOW

(71) Applicant: John Derkson, Greensburg, KY (US)

(72) Inventor: John Derkson, Greensburg, KY (US)

( * ) Notice: Subject to any disclaimer, the term of this patent is extended or adjusted under 35 U.S.C. 154(b) by 0 days.

(21) Appl. No.: 15/615,881

(22) Filed: Jun. 7, 2017

(65) Prior Publication Data

US 2018/0355581 A1 Dec. 13, 2018

(51) Int. Cl.

| | |
|---|---|
| ***E02F 5/02*** | (2006.01) |
| ***E02F 5/10*** | (2006.01) |
| *E02F 3/04* | (2006.01) |
| *E02F 5/12* | (2006.01) |

(52) U.S. Cl.

CPC ..... *E02F 5/02* (2013.01); *E02F 5/106* (2013.01); *E02F 3/04* (2013.01); *E02F 5/12* (2013.01)

(58) Field of Classification Search

CPC ..... E02F 5/02; E02F 5/106; E02F 5/12; E02F 3/04

See application file for complete search history.

(56) References Cited

U.S. PATENT DOCUMENTS 713,692 A * 11/1902 Schopf ..... E02F 5/102 405/181
970,818 A * 9/1910 Harryman ..... E02F 5/102 37/370
3,111,007 A * 11/1963 Ryan ..... H02G 1/06 292/241
3,286,476 A * 11/1966 Maclay ..... E02F 5/102 172/239
3,406,525 A * 10/1968 Kinnan ..... E02F 3/963 37/367
3,486,344 A * 12/1969 Ylinen ..... E02F 3/76 172/784
3,611,596 A * 10/1971 Bright et al. ..... E02F 5/102 172/744
3,782,480 A * 1/1974 Schmahl ..... E02F 5/103 172/110
4,200,410 A * 4/1980 Baker ..... E02F 5/103 172/40
4,537,531 A * 8/1985 Diefenthaler ..... E02F 5/08 405/156
4,718,182 A * 1/1988 Toomey ..... E02F 3/627 172/699
4,861,195 A * 8/1989 Hillard ..... E02F 5/102 37/367
5,090,141 A * 2/1992 Hall ..... A01B 35/28 172/744
5,975,804 A 11/1999 Bockman
7,637,697 B1 * 12/2009 Holland ..... E02F 5/00 405/174
8,090,507 B2 1/2012 Yegerlehner et al.
2002/0100192 A1 * 8/2002 Kenkel ..... E02F 5/102 37/367
2009/0311049 A1 * 12/2009 Hoelting ..... E02F 3/80 405/180
2012/0195688 A1 8/2012 Bell

* cited by examiner

*Primary Examiner* — Jamie L McGowan

(74) *Attorney, Agent, or Firm* — Stockwell & Smedley, PSC

(57) ABSTRACT

A tile plow, including a pivot bolt, a frame, a shank including a bottom at a first end of the shank, a top at a second end opposite the first end of the shank, a height measured from the bottom to the top, and a male connector, the shank hingeably connected with the frame at the pivot bolt, wherein the pivot bolt is positioned, in a direction extending from the bottom towards the top, at 66.4 percent of the height or more.

16 Claims, 7 Drawing Sheets

MODULAR TILE PLOW

FIELD OF THE INVENTION

The present invention relates generally to field tile drainage and, more particularly, to methods and equipment for ditching and tiling a field.

BACKGROUND

Excess subsurface water can be detrimental for farmers. For example, excess water can compact the soil, which can exclude oxygen, inhibit root development and/or allow shallow root development, and may stunt crop growth. Furthermore, excess water may cause muddy conditions, in which farm equipment may spin and further damage the ground.

Field drainage tile may typically include perforated corrugated plastic pipe. When placed underground, water may enter the perforations of the tile. Furthermore, tile may be laid in a sloping position. Thereby, water entering the tile may be drained down-slope and away from the field. In this manner, excess water may be removed from the field and the water table may be prevented from rising above the tile.

SUMMARY

Aspects of the present invention relate to a tile plow, including a pivot bolt, a frame, a shank including a bottom at a first end of the shank, a top at a second end opposite the first end of the shank, a height measured from the bottom to the top, and a male connector, the shank hingeably connected with the frame at the pivot bolt, wherein the pivot bolt is positioned, in a direction extending from the bottom towards the top, at 66.4 percent of the height or more.

Additional aspects of the invention relate to a tile plow, including a pivot bolt, a frame, a shank, hingeably connected with the frame at the pivot bolt, the shank including a male connector, a bottom connection, a top, and a shank arc extending from the bottom connection to the top, wherein the shank arc comprises a shank arc radius, a shank arc length, and a shank arc angle, and a pivot bolt arc extending from the bottom connection to an orthogonal plane passing through a horizontal center of the pivot bolt, wherein the pivot bolt arc comprises a pivot bolt arc radius, a pivot bolt arc length, and a pivot bolt arc angle, the pivot bolt arc angle at least 68 percent of the shank arc angle.

Further embodiments of the invention relate to a tile plow, including a chisel including a top, a foot at a bottom opposite the top, a female connector configured to receive a male connector of a shank, a blade at a forward edge of the foot, and a tile feed spanning from the top to a rearward edge of the foot opposite the blade, the tile feed including an intake at the top, a straight section connected to the intake, a tile feed arc connected to the straight section opposite the intake, and an output connected to the tile feed arc opposite the straight section, wherein the tile feed arc includes a tile feed arc length, a tile feed arc angle, and a tile feed arc radius, wherein a length of the straight section is 56 percent of the height of the chisel or greater, the height of the chisel is measured from the foot to the top of the intake of the tile feed.

BRIEF DESCRIPTION OF THE DRAWINGS

Various aspects of the present invention are illustrated by way of example, and not by way of limitation, in the accompanying drawings.

DETAILED DESCRIPTION OF THE PREFERRED EMBODIMENTS

Figure 1:
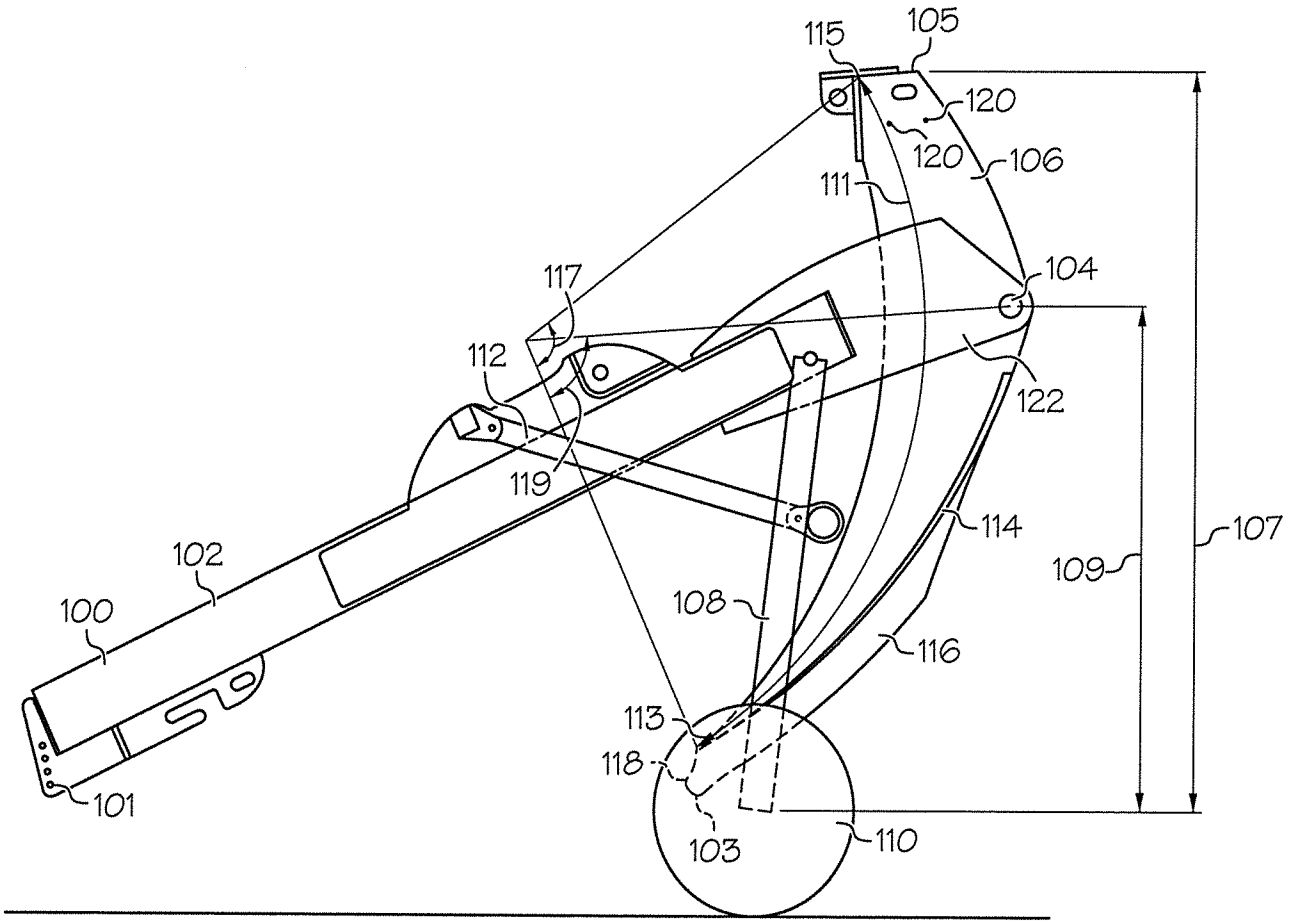
FIG. 1 depicts a diagram of a shank of a tile plow in accordance with the principles of the present invention.

The present invention relates to, but is not limited to, field tile drainage, including methods and equipment for ditching and tiling a field.

The detailed description set forth below in connection with the appended drawings is intended as a description of various embodiments of the invention and is not intended to represent the only embodiments in which the invention may be practiced. The detailed description includes specific details for the purpose of providing a thorough understanding of the invention. However, it will be apparent to those skilled in the art that the invention may be practiced without these specific details. In some instances, well known structures and components are shown in block diagram form in order to avoid obscuring the concepts of the invention.

Excess subsurface water can be detrimental for farmers. For example, excess water can compact the soil, which can exclude oxygen, inhibit root development and/or allow shallow root development, and may stunt crop growth. Furthermore, excess water may cause muddy conditions, in which farm equipment tires may spin and further damage the ground.

Field drainage tile may typically include perforated corrugated plastic pipe, as well as any other pipe suitable for collecting water from the surrounding ground. When placed underground, water may enter the perforations of the tile. Furthermore, tile may be laid in a sloping position. Thereby, water entering the tile may be drained down-slope and away from the field. In this manner, excess water may be removed from the field and the water table may be prevented from rising above the tile.

Drainage tile plows may be used to place tile in underground rows. For example, a prime mover, such as a tractor, may be connected to a large frame connected with a shank that is, in turn, connected with a chisel. The chisel may be used to cut a ditch through the ground. The shank may direct the dirt to the top of the ditch while releasing tile at the bottom of the ditch. The dirt may then be dropped over the tile to refill the ditch. The resulting field may contain one or more rows of drainage tile. Therefore, the field may have a lower water table and improved drainage for superior soil and crop development.

Many tile plows allow for laying a single size of drain tile. However, embodiments of the present invention include a modular tile plow comprising a frame and an interchangeable chisel. Furthermore, the chisel may be fitted with one of variously sized tile feeds, such that the chisel may be interchanged for another chisel of a different tile diameter. Thus, changing tile diameter may occur by swapping chisels rather than changing to an entirely different plow.

Further embodiments of the present invention include a higher bolt and/or a tighter tile feed arc to support the shank and chisel while tiling and turning. In some embodiments, the higher bolt placement and/or tighter tile feed arc may reinforce the shank and/or chisel such that the plow does not break while tiling and turning. Higher bolt placement and/or tighter tile feed arc may further allow less cross-directional resistance when turning and tiling.

In the description herein, "hingeably" and similar variations refer to rotation about a point as if on a hinge, axle, etc. Thus, any structure sufficient for hingeable relationship may be used, unless a specific structure is explicitly stated as required.

As used herein, "proximate" means the referenced structure is closer than any other structure, when proximate is used in absolute referenced (alternatively, "proximate" can be used relatively between multiple structures). For example, if the anchor is "proximate" the bottom of the shank, the anchor is closer to the bottom than any other structure of the shank or any other structure touching the shank.

When used relatively herein, "proximate" means the referenced proximate structure is closer than the other referenced structures. For example, if the anchor is proximate the bottom relative to the shank rim, the anchor is closer to the bottom than the shank rim.

As used herein, "near" means within ⅓ of the area of the container unit. For example, if a portion of the male connector is described as "near" the pivot bolt, this portion is within ⅓ of the shank length from the pivot bolt (e.g. the shank is the container unit that touches both "near" structures).

As used herein, "about" means within plus or minus one at the last reported digit. For example, about 1.00 means 1.00±0.01 unit. In fractions, about 1 1/16 units means from 1 9/16 units to 1 23/16 units. In percentages, about 11% means 10% to 12%.

"Substantially," as used herein with reference to a shape, means within manufacturing tolerance of manufacturing the referenced shape as well as any other shape falling within the doctrine of equivalents for the referenced shape.

Any directional words, such as "top," "bottom," "up," "down," etc. used herein refer to the direction depicted in the figure described. If the described device is rotated, these directions remain indicative of the position described relative to the figure.

FIG. 1 depicts a diagram of a frame 102 of a tile plow 100 in accordance with the principles of the present invention. The frame 102 may be hingeably attached to a shank 106. For example, the hingeable attachment between the frame 102 and the shank 106 may be at a bolt 104. The frame 102 may be disposed generally in a major plane of the frame 102. The shank 106 may have a longitudinal axis intersecting the major plane of the frame 102.

The frame 102 further comprises one or more braces 108. For example, some embodiments include two braces 108. Each brace 108 may be pivotally attached to the frame 102 at a first end of the brace 108. Each brace 108 may also be pivotally attached to a wheel 110 at a second end of the brace 108. In this manner, the frame 102 may be attached to a prime mover at a first end of the frame 102. The second end of the frame 102 may be supported by wheels 110 such that a prime mover may pull the frame 102. Furthermore, the shank 106 may be positioned at the second end of the frame 102.

The longitudinal axis of the shank 106 may be generally vertical when the wheels 110 are on the ground. Additionally, the shank 106 may be pivotally connected to one or more pistons 112. The piston 112 may be hydraulic or pneumatic. The piston 112 may also be pivotally connected to the frame 102. Thus, the piston 112 may regulated the shank 106 such that the longitudinal axis of the shank 106 remains generally vertical as the first end of the frame 102 is raised and/or lowered. For example, when the first end of the frame 102 is raised, the shank 106 may pivot at the bolt 104 such that the longitudinal axis of the shank 106 remains generally vertical (e.g. generally perpendicular to the ground) and the shank 106 may be simultaneously lowered to and/or below the ground due to leverage about the wheels 110.

In some embodiments, the shank 106 may comprise a generally arcuate body. The top of the body may comprise one or more pin holes 120. These pin holes 120 may be configured to receive a pin for attachment to peripheral devices. Furthermore, the frame 102 may comprise wings 122. The wings 122 may be positioned around the shank 106 and may be pivotally secured to the shank 106 by pivot bolt 104. Thus, wings 122 may be proximate the pivot bolt.

The shank 106 may comprise a shank rim 114 extending laterally from the shank 106 and spanning from the bottom of the shank 106 to a position near the pivot bolt 104. Dirt may be directed up the shank rim 114 from the bottom such that dirt is removed for laying the tile during the ditching process. The dirt may then be replaced as the dirt overflows the top of the shank rim 114. The bottom of the shank 106 may comprise a male connector 116. The male connector 116 may be connected with and/or integrally formed with the bottom of the shank rim 114. The male connector 116 may span from about the shank rim 114 near the bottom 103 of the shank 106 and may extend the arc of the underside of the shank 106 below the shank rim 114. Furthermore, the male connector 116 may taper (e.g. decrease in orthogonal distance from the shank 106) near the pivot bolt 104. This taper may allow the chisel to rest against the shank 106. The first end of the male connector 116 may comprise an anchor 118. The anchor 118 may have a rounded cross section in the plane of the male connector 116. The cross section of the anchor 118 may extend beyond the cross section of the male connector 116. Furthermore, the anchor 118 may be wider than the male connector 116.

Some embodiments of the present invention include a higher bolt and/or a tighter tile feed arc to support the shank and chisel while tiling and turning. In some embodiments, the higher bolt placement and/or tighter tile feed arc may reinforce the shank and/or chisel such that the plow does not break while tiling and turning. Higher bolt placement and/or tighter tile feed arc may further allow less cross-directional resistance when turning and tiling.

In embodiments disclosed herein, a shank height 107 may be measured from the bottom 103 of the shank 106 at the anchor 118 to the top 105. Furthermore, the pivot bolt height 109 may be measured from the bottom 103 to a horizontal diameter of the pivot bolt 104. Thus, the pivot bolt 106 may be 66.4 percent of the shank height 107 or higher. In some embodiments, the shank height 107 may be 304.0 cm (119.7 inches) (e.g. from the bottom 103). Furthermore, the pivot bolt height 109 may be 201.9 cm (79.5 inches) or higher (e.g. 201.9 cm (79.5 inches) from the bottom 103).

In further embodiments of the tile plow 100, a shank arc 111 may be measured from a first end 113 of the shank rim 114 to a forward corner 115 of the top 105. A pivot bolt arc may be measure from the first end 113 to an orthogonal plane passing through the horizontal center of the pivot bolt 104. The pivot bolt arc length may be 68.0 percent of the shank arc length or greater from the first end 113. The pivot bolt arc may be 68.0 percent of the shank arc angle or greater from the first end 113. The pivot bolt arc angle 119 may be 70.45 degrees or greater from the first end 113. The shank arc angle 117 may be 103.58 degrees or greater from the first end 113. In some embodiments, the radius of the shank arc may be about 189.7 cm (74.7 inches). Furthermore, the radius of the pivot bolt arc may be about 189.7 (74.7 inches).

Figure 2:
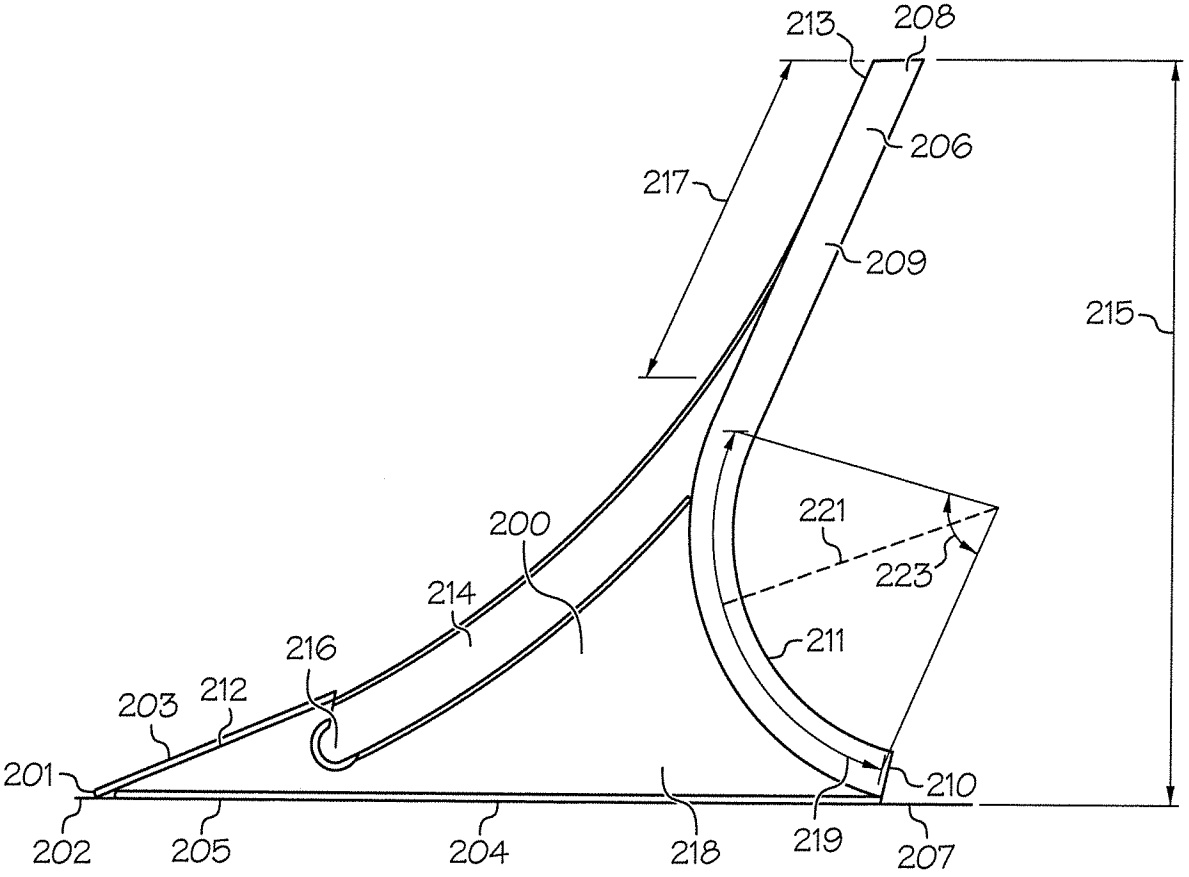
FIG. 2 depicts a diagram of a chisel of the tile plow of FIG. 1 in accordance with the principles of the present invention.

FIG. 2 depicts a cross-sectional diagram of a tile plow chisel 200 in accordance with the principles of the present invention. This chisel 200 may comprise a blade 202 at a forward edge 201 for plowing through dirt, a foot 204, a tile feed 206, a chisel rim 212 for guiding plowed dirt away from the foot 204, and/or a female connector 214. The chisel 200 may be attachable and/or detachable from the shank 106 via connection of the male connector 116 of the shank 106 with the female connector 214 of the chisel 200. In this manner, the chisel 200 may be joined to the frame 102. The prime mover may be attached to the frame 102 at hitch 101. The frame 102 may be positioned to lower the shank 106 and chisel 200 below the ground. The depth of the foot 204 of the chisel 200 and the grade may be adjusted to a desired ditch depth and ditch grade.

In some embodiments, chisel 200 may be attachable to the shank 106 by the mating of male connector 116 with female the female connector 214. Furthermore, one or more bolt holes 120 may be positioned near the top of the shank 106 (e.g. within the top third of the length of the shank 106). In this manner, shank 106 may receive attachment bolts from chisel 200. In these embodiments, chisel 200 may be connected to the shank 106 at multiple points such that pressure from digging may be distributed at multiple points on the shank 106. Furthermore, chisel 200 may be easily removed and reattached to shank 106. By way of example, this modularity of the chisel 200 may allow for interchangeability for varied sizes of tile feeds 206, varied chisel blades 202, and/or for replacement of broken chisels 200.

The chisel 200 may comprise the blade 202 at the forward edge 201 of the chisel 200. The blade 202 may cut through dirt as the chisel 200 slides through the ground during ditching. This dirt may be guided away from the ditch floor 207 by the top 203 of the chisel blade 202 to the chisel rim 212. The chisel rim 212 may span the width of the ditch such that dirt is guided up the chisel rim 212 and away from the blade 202 and/or ditch floor 207. The chisel bottom 205 and/or foot 204 may provide a planar surface for cutting the ditch floor 207.

Foot 204 may comprise a generally planar plate. Furthermore, foot 204 may extend from blade 202 to an output 210 of a tile feed 206. Foot 204 may aid in straightening the bottom of the ditch during tiling. For example, tile is often laid at a slight grade for improved drainage. Foot 204 may aid in keeping the grade precise and/or consistent. In embodiments, wherein level tile is desired, foot 204 may aid in leveling the bottom of the ditch.

Tile feed 206 may comprise a tube comprising an outer diameter, an inner diameter and a length. Thus, the tile feed may be configured to receive tile in an intake 208 and release the received tile through the output 210. The tile feed may comprise a straight section and/or an arcuate section. For example, the tile feed 206 may be sized to receive one of 10.16 cm (4 inch), 15.24 cm (6 inch), 20.32 cm (8 inch), or 25.4 cm (10 inch) diameter tile.

A support 218 may span the face from the foot 204 to the blade 202 to the chisel rim 212 to the female connector 214 to the tile feed 206. In some embodiments, two supports 218 may be situated on opposite faces of the chisel 200. Further embodiments include modular supports 218, such that the supports 218 can be removed. The supports 218 may support the walls of the ditch as tiling progresses.

Female connector 214 may extend from the chisel rim 212 generally vertically to the tile feed 206. The female connector 214 may be configured to receive male connector 116 such that chisel 200 may be connected with shank 106. Furthermore, the female connector 214 may comprise a receiver 216 near the chisel rim 212. The receiver 216 may be proximate the bottom 205 relative to the remainder of the female connector 214. The receiver 216 may be configured to receive anchor 118 when the male connector 116 is within female connector 214. Furthermore, receiver 216 may be configured to reversibly lock with anchor 118, such that male connector 116 may remain within female connector 216 while receiver 216 and anchor 118 are in the locked configuration. In some embodiments, the male connector 116 and female connector 214 may be configured to lock when the female connector 214 receives the male connector 116. Further embodiments include a bolt extending though the female connector 214 and the male connector 116, while the male connector 116 is received by the female connector 214, such that the bolt may prevent removal of the male connector 116 from the female connector 214.

By way of example, the shank 106 may be connected to the chisel 200 by the mating of the male connector 116 with the female connector 214. In this position, chisel rim 212 may be configured such that dirt may be pushed from the blade 202 to the chisel rim 212 and transported from chisel rim 212 to shank rim 114. In some embodiments, an external surface of the chisel rim 212 may butt against the shank rim 114 such that the chisel rim 212 and shank rim 114 may be generally flush. In these embodiments, the shank 106 and chisel 200 may be dragged through the ground such that the blade 202 cuts a ditch. The removed dirt may be transported over the chisel rim 212, onto and over the shank rim 114, and dropped onto the tile in the ditch after the tile exits the output 210 of the tile feed 206. In alternative embodiments, the portion of the shank rim 114 proximate the chisel rim 212 may be positioned proximate the foot 204 relative to said portion of the chisel rim 212. In this manner, dirt may be dropped from the chisel rim 212 onto the shank rim 114 during plowing operation.

The tile feed 206 may comprise a straight section 209 of hollow pipe extending from the intake 208 at the top 213 of the chisel 200 to a tile feed arc 211. The tile feed arc 211 may comprise an arcuate section of hollow pipe extending from the straight section 209 to the bottom 205 of the chisel 200. In some embodiments, a major axis of the straight section 209 may be angled at 64.7 degrees relative to the plane of the bottom 205 near the output 210. The length 217 of the straight section 209 may be 122.3 cm (48.168 inches). The height of the tile feed 206 from the edge of the output 210 at the bottom 205 to the input 208 at the top 213 may be 218.7 cm (86.1 inches). The chisel height 215 may be substantially similar to the height of the tile feed 206 (e.g. 218.7 cm). Furthermore, the tile feed arc 211 may comprise an arc length 219 of 117.5 cm (46.247 inches), a radius 221 of 66.7 cm (26.25 inches), and a tile feed arc angle 223 of 100.94 degrees.

Some embodiments of the present invention include a tighter tile feed arc in order to allow for less resistances when the tile plow 100 is turning while the chisel 200 is plowing. For example, the length 217 of the straight section 209 may be greater than 122.3 cm (48.168 inches). The tile feed arc length 219 may be less than 117.5 cm (46.247 inches). The tile feed arc radius 221 may be less than 66.7 cm (26.25 inches). The tile feed arc angle 223 may be less than 100.94 degrees. In some embodiments, the angle of the straight section 209 may be greater than 64.73 degrees. In some embodiments, the length 217 of the straight section 209 may be 56 percent of the height 215 of the chisel or greater. In some embodiments, the arc length 219 of the tile feed arc 211 may be 53.6 percent of the height 215 of the chisel or less.

Figure 3:
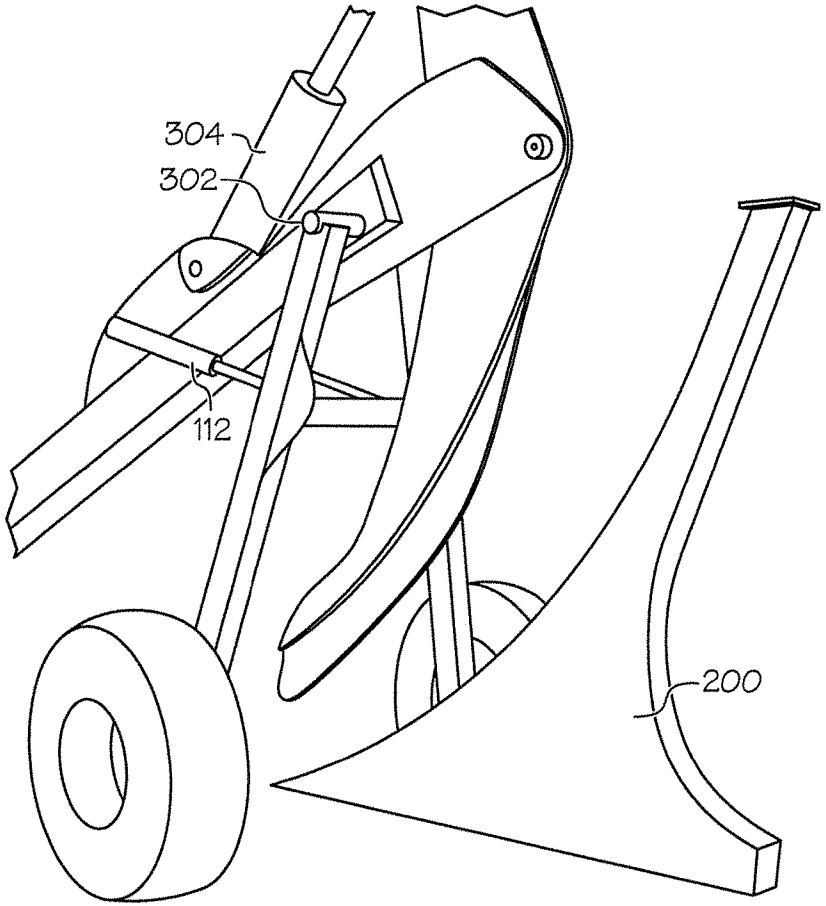
FIG. 3 depicts the alignment of the frame of FIG. 1 and the tile plow chisel of FIG. 2 in accordance with the principles of the present invention.

FIG. 3 depicts the alignment of the frame of FIG. 1 and the tile plow chisel 200 of FIG. 2 in accordance with the principles of the present invention. This view depicts the interaction of the piston 112 with the braces 108 and the frame 102. For example, the braces 108 may be hingeably attached to the frame 102 at an axle 302 at a first end and rotatably attached to wheels at a second end. In this manner, the frame 102 may be attached at hitch 101 and pulled by primary mover. Furthermore, piston 112 may adjust the position of the braces 108 for positioning the shank 106. When contracted, the piston 112 may lower the shank 106 in proportion to the trigonometric relationship between the length of the brace 108 as the hypotenuse, the height of axle 302 from the ground, and the angle of the brace 108 relative to vertical. When expanded, the full length of brace 108 may align with vertical below the axle 302 such that the height of the axle may be at its apex.

Shank piston 304 may be attached to the shank 106 above the pivot bolt 104 and the frame 102 such that expansion and/or contraction of the shank piston 304 may control the rotation of the shank 106 about pivot bolt 104.

For example, expansion of the shank piston 304 may pull the bottom 103 toward the hitch 101 of the frame 102. In this manner, expansion of the shank piston 304 may increase the upward slope of the ditch floor 207 (e.g. upward toward the blade 202), when attached and digging. On the other hand, contraction of the shank piston 304 may push the bottom 103 away from the hitch 101. Such contraction while digging may decrease the upward slope or even result in a downward sloped ditch floor 207.

Figure 4:
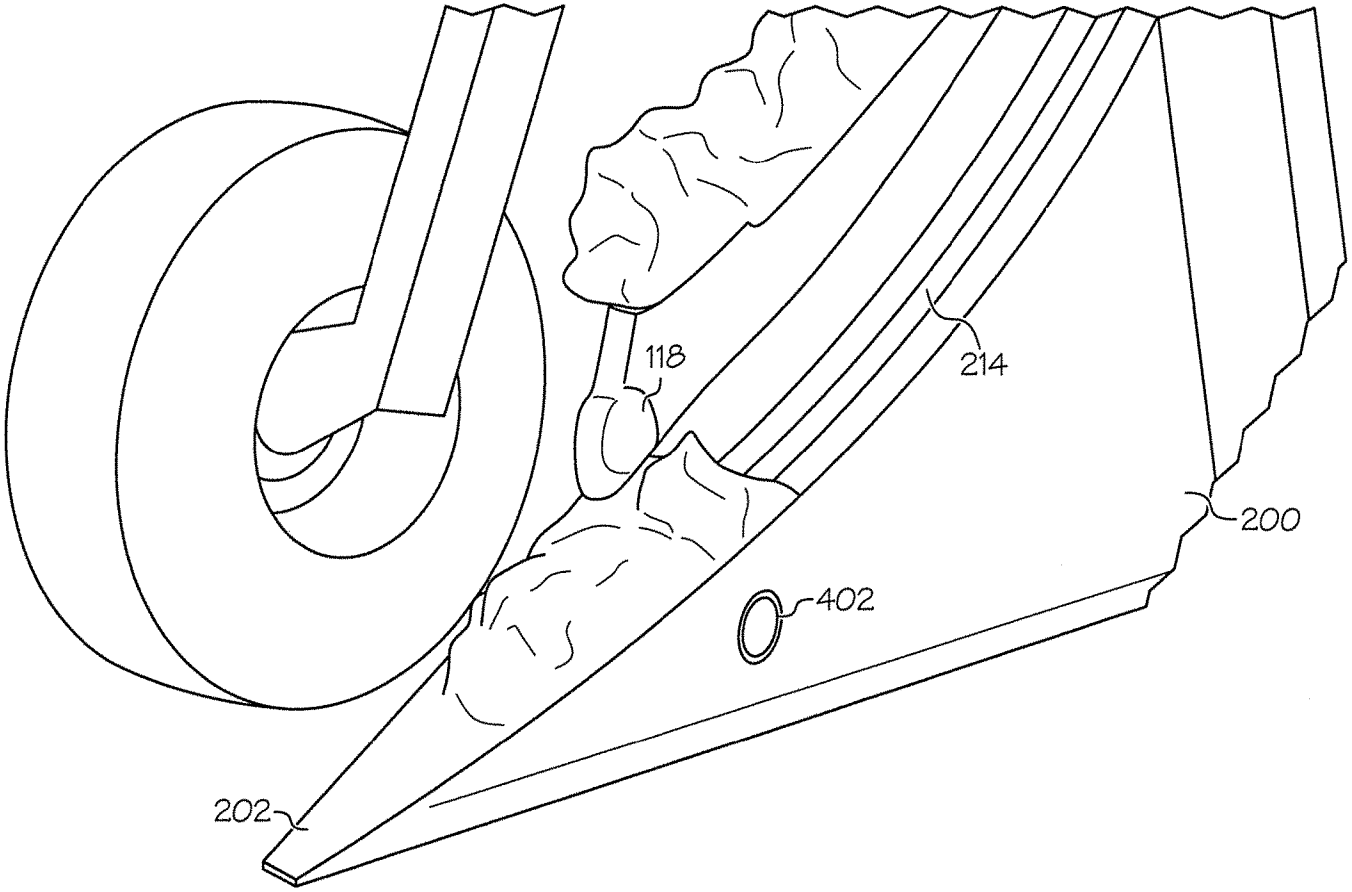
FIG. 4 depicts an attachment mechanism of the shank of FIG. 1 and the chisel of FIG. 2 in accordance with the principles of the present invention.

FIG. 4 depicts an attachment mechanism of the frame of FIG. 1 and the chisel 200 of FIG. 2 in accordance with the principles of the present invention. Anchor 118 may be positioned at the bottom 103 of the shank 106. The anchor 118 may comprise a wider width than the male connector 116. The anchor 118 may comprise a wider width than the female connector 214. Thus, the anchor 118 may be inserted at the top of the female connector 214 and slid down into a receiver 402 of the female connector 214. The anchor 118 may frictionally fit with the receiver 402. Furthermore, the male connector 116 and female connector 214 may further have similar widths such that the male connector 116 may frictionally fit with the female connector 214.

Figure 5:
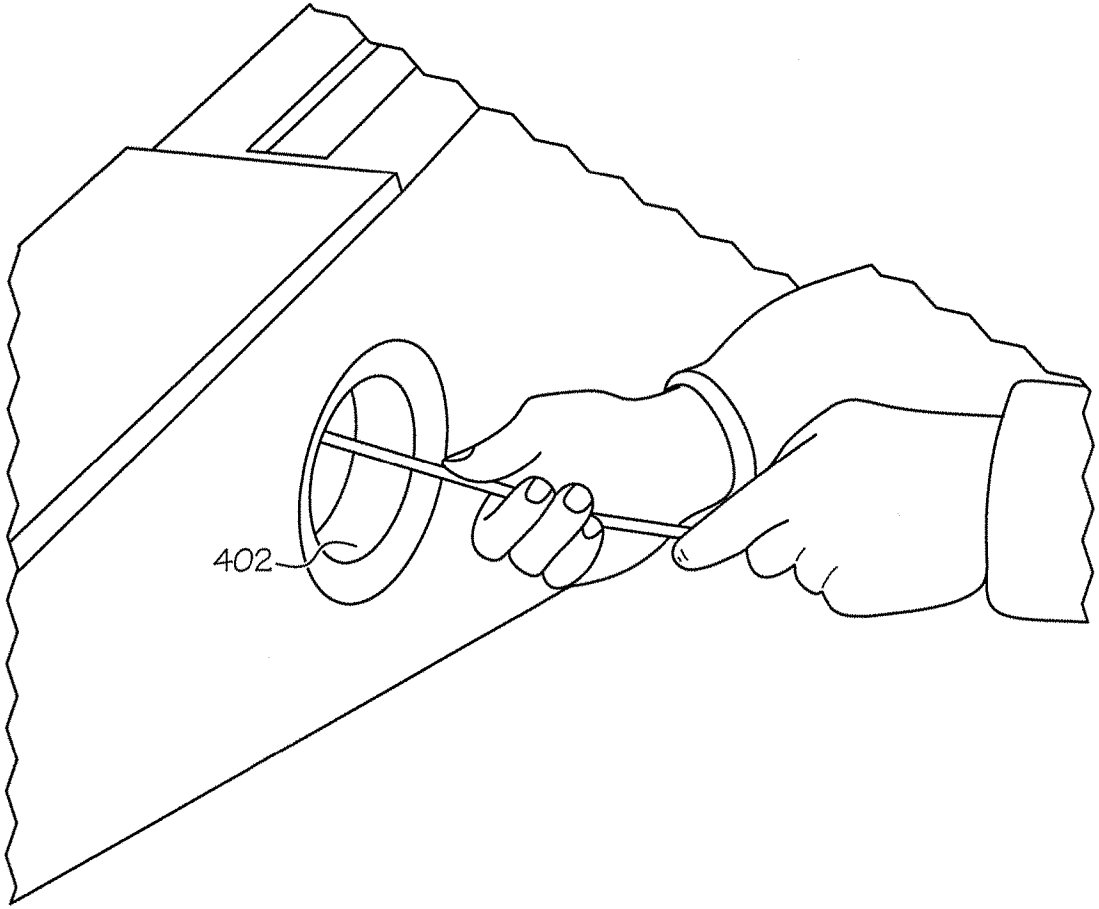
FIG. 5 depicts a receiver of the chisel of FIG. 2 in accordance with the principles of the present invention.

FIG. 5 depicts the receiver 402 of the chisel 200 of FIG. 2 in accordance with the principles of the present invention. As depicted, the receiver 402 may comprise one or two transverse holes extending through one or both of the supports 118 of the sides of the chisel 200. These transverse holed may be useful for cleaning out dirt from the female connector 214 that may collect during plowing.

Figure 6:
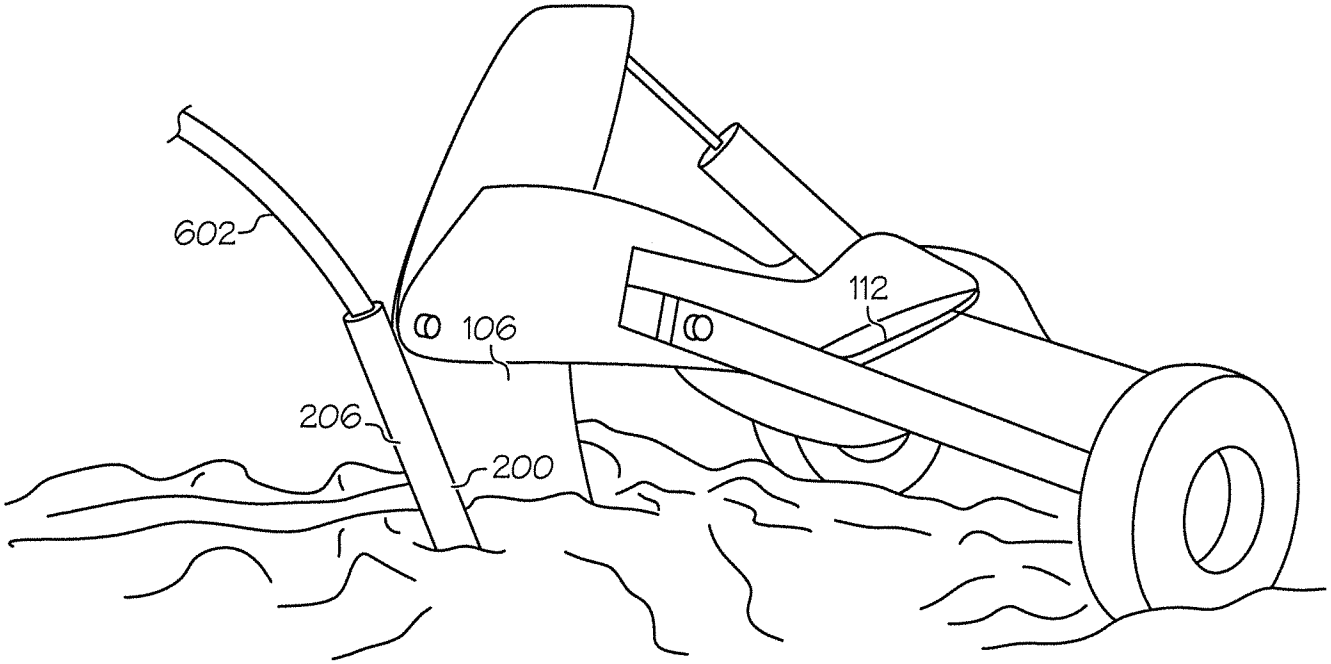
FIG. 6 depicts the frame of FIG. 1 connected with the chisel of FIG. 2 while ditching and tiling a field in accordance with the principles of the present invention.

FIG. 6 depicts the frame of FIG. 1 connected with the chisel 200 of FIG. 2 while ditching and tiling a field in accordance with the principles of the present invention. As can be seen, drainage tile 602 is being fed through tile feed 206 into the ground. The chisel 200 is attached to the shank 106. Furthermore, piston 112 is in the contracted position such that the braces 108 allow the frame 102 to be positioned close to the ground due to the acute angle between the braces 108 and the frame 102.

Figure 7:
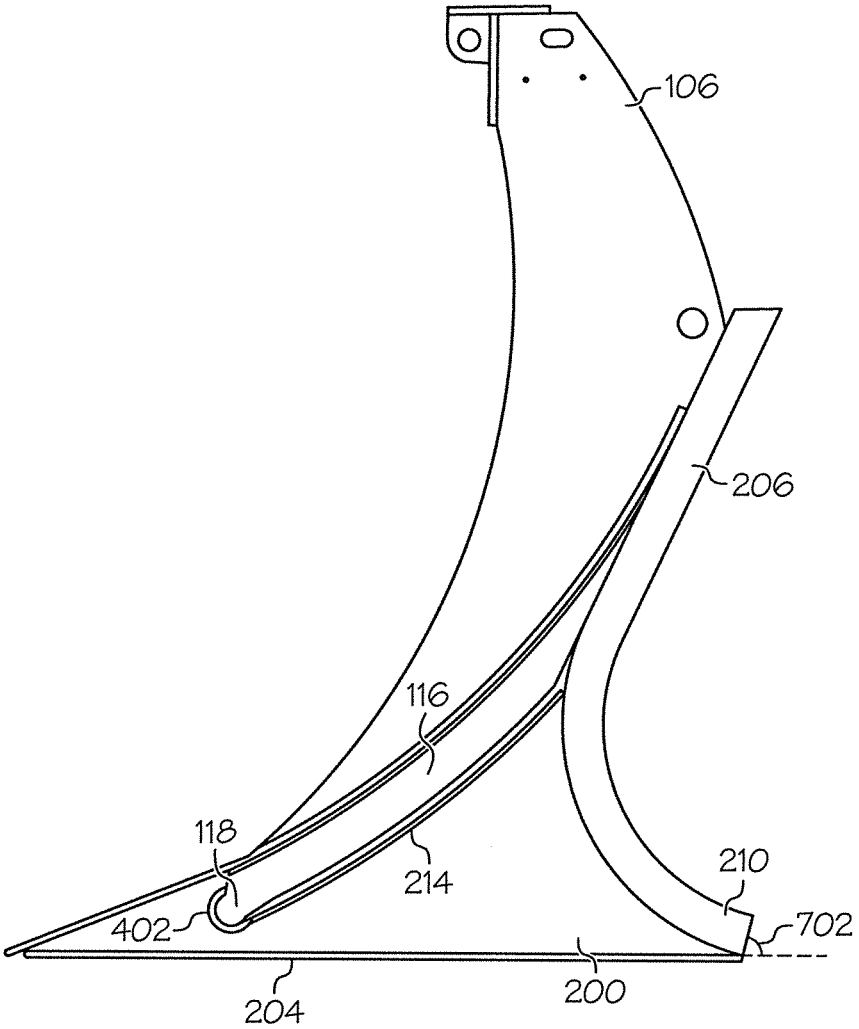
FIG. 7 depicts the attachment of the shank of FIG. 1 and the chisel of FIG. 2 in accordance with the principles of the present invention.

FIG. 7 depicts the attachment of the shank 106 of FIG. 1 and the chisel 200 of FIG. 2 in accordance with the principles of the present invention. As can be seen in this example, the male connector 116 is fit within the female connector 214 (e.g. frictional fit). Furthermore, anchor 118 may be frictionally fit with receiver 402. In this manner, pivoting the shank 106 about pivot bolt 104 may guide the blade 202 and foot 204 to alter the grade of the ditch. Furthermore, the output angle 702 of the output 210 is illustrated. For example, the output angle 702 may be about 75 degrees relative to a plane of the foot extending away from output 210.

The previous description is provided to enable any person skilled in the art to practice the various embodiments described herein. Various modifications to these embodiments will be readily apparent to those skilled in the art, and the generic principles defined herein may be applied to other embodiments. Thus, the claims are not intended to be limited to the embodiments shown herein, but are to be accorded the full scope consistent with each claim's language, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

What is claimed is:

1. A tile plow, comprising:

a pivot bolt;

a frame;

a shank comprising:

a bottom at a first end of the shank, a top at a second end opposite the first end of the shank, a height measured from the bottom to the top, and a male connector;

the shank hingeably connected with the frame at the pivot bolt, wherein the pivot bolt is positioned, in a direction extending from the bottom towards the top, at 66.4 percent of the height or more; and a chisel comprising:

a female connector configured to engageably interface with the male connector of the shank, and a chisel rim extending from a blade at a forward edge of the chisel at least to the female connector.

2. The tile plow of claim 1, wherein the pivot bolt is positioned at 201.9 cm or higher from the bottom of the shank, and wherein the height of the shank is about 304.0 cm.

3. The tile plow of claim 1, wherein the shank further comprises a shank rim extending along at least a portion of an arc length of the male connector from a first end of the male connector.

4. The tile plow of claim 1, wherein the chisel rim is configured to transition dirt to a shank rim during plowing operation with the shank connected with the chisel.

5. A tile plow, comprising:
a pivot bolt;
a frame;
a shank, hingeably connected with the frame at a pivot bolt, wherein the pivot bolt is positioned, in a direction extending from the bottom towards the top, at 66.4 percent of the height or more, the shank comprising:
a male connector,
a bottom at a first end of the shank,
a bottom connection,
a top at a second end opposite the first end of the shank,
a height measured from the bottom to the top, and
a shank arc extending from the bottom connection to the top, wherein the shank arc comprises a shank arc radius, a shank arc length, and a shank arc angle;
a chisel comprising:
a female connector configured to engageably interface with the male connector of the shank, and
a chisel rim extending from a blade at a forward edge of the chisel at least to the female connector; and
a pivot arc extending from the bottom connection to an orthogonal plane passing through a horizontal center of the pivot bolt, wherein the pivot bolt arc comprises a pivot bolt arc radius, a pivot bolt arc length, and a pivot bolt arc angle, the pivot bolt arc angle at least 68 percent of the shank arc angle.

6. The tile plow of claim 5, wherein the pivot bolt arc angle is about 70.45 degrees or greater.

7. The tile plow of claim 6, wherein the shank arc angle is about 103.6 degrees.

8. The tile plow of claim 5, wherein the shank arc radius is about 189.7 cm.

9. A tile plow, comprising:
a chisel comprising:
a top;
a foot at a bottom opposite the top;
a female connector configured to receive a male connector of a shank;
a blade at a forward edge of the foot;
a chisel rim extending from the blade to the female connector; and
a tile feed spanning from the top to a rearward edge of the foot opposite the blade, the tile feed comprising:
an intake at the top,
a straight section connected to the intake,
a tile feed arc connected to the straight section opposite the intake, and
an output connected to the tile feed arc opposite the straight section,
wherein the tile feed arc comprises:
a tile feed arc length,
a tile feed arc angle less than 100.94 degrees, and
a tile feed arc radius,
wherein a length of the straight section is 56 percent of the height of the chisel or greater, the height of the chisel is measured from the foot to the top of the intake of the tile feed.

10. The tile plow of claim 9, wherein a major axis of the straight section is positioned at an angle of about 64.7 degrees relative to a plane of the foot of the chisel.

11. The tile plow of claim 9, wherein the height of the chisel is about 218.7 cm from the top of the intake to the bottom of the foot.

12. The tile plow of claim 9, wherein the tile feed arc comprises the arc length of the 53.6 percent of the height of the chisel or less.

13. The tile plow of claim 9, wherein the tile feed arc comprises the radius of 66.7 cm or smaller.

14. The tile plow of claim 9, further comprising:
a shank comprising a male connector, the shank hingeably connected to a frame of the tile plow by a pivot bolt.

15. The tile plow of claim 14, wherein the shank further comprises a shank rim extending at least a portion of a length of the male connector.

16. The tile plow of claim 15, wherein the chisel rim is configured to transition dirt onto the shank rim when the shank is connected to the chisel and when the chisel is pulled through the ground.

* * * * *